US006396018B1

(12) United States Patent
Kinoshita et al.

(10) Patent No.: US 6,396,018 B1
(45) Date of Patent: May 28, 2002

(54) POWER CIRCUIT SWITCH

(75) Inventors: Hirotsugu Kinoshita; Kiyomi Sakamoto, both of Kanagawa-ken; Kimiya Sato, Saitama-ken; Makoto Kataoka, Tokyo; Atsushi Ohashi, Kanagawa-ken; Tomio Takahashi, Tokyo, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/670,097

(22) Filed: Sep. 26, 2000

(30) Foreign Application Priority Data

Sep. 30, 1999 (JP) ..... 11-279602

(51) Int. Cl.[7] ..... H01H 33/02; H01H 3/00; H01H 3/24

(52) U.S. Cl. ..... 218/154; 218/84; 218/120

(58) Field of Search ..... 335/167–170; 218/7, 14, 78, 84, 154, 153

(56) References Cited

U.S. PATENT DOCUMENTS 4,016,383 A * 4/1977 Nicoloso ..... 218/146

4,392,968 A * 7/1983 Ishida et al. ..... 252/51.5

FOREIGN PATENT DOCUMENTS

| | | | |
|---|---|---|---|
| JP | 57-33646 | | 7/1982 |
| JP | 5-149341 | * | 6/1993 |

* cited by examiner

*Primary Examiner*—Lincoln Donovan
(74) *Attorney, Agent, or Firm*—Oblon, Spivak, McClelland, Maier & Neustadt, P.C.

(57) ABSTRACT

There are provided an operating mechanism that drives the opening/closing of contacts, and a sliding conduction part that forms electrical connection of these contacts and the main circuit on receipt of a connection voltage; grease is applied to the mechanical sliding part of the operating mechanism and to the sliding conduction part. The grease has as base oil at least one synthetic oil and is selected from the group consisting of poly α-olefins and dialkyl diphenyl ethers, and contains as thickener 5–30 mass % of a urea compound. The dynamic viscosity of the base oil is 30–500 $mm^2/s$ at 40° C.

15 Claims, 4 Drawing Sheets

POWER CIRCUIT SWITCH

BACKGROUND OF THE INVENTION

1. Field of the Invention

The present invention relates to a power circuit switch and more particularly particular relates to a power circuit switch whose performance is improved by altering the grease that is applied to the sliding part constituting the power circuit switch and the sliding conduction part.

2. Description of the Related Art

In high-voltage, high-current power circuits, compared with low-voltage, low-current power circuits, the physical impact and/or resistance caused by contact/separation of the contacts on switching the power circuit are considerable. Consequently, a power circuit switch for switching high-voltage/high-current power circuits is typically provided with a high-voltage charging unit equipped with a vacuum valve (vacuum interrupter) for actually performing the switching of the power circuit and an operating mechanism for mechanically operating this vacuum valve.

A vacuum valve is provided with a pair of contacts (electrodes); switching of the power circuit that is connected thereto is effected by contacting/separating these contacts. The operating mechanism performs a mechanical reciprocating action on the contacts in order to effect contact/separation of the contacts. Such an operating mechanism comprises a sliding member such as a bearing for effecting reciprocating action; grease that gives lubrication is applied to the sliding member in order to maintain a smooth action and to prevent frictional wear.

Also, the power circuit switch is provided with a conductive part for effecting electrical connection with the main circuit; in this conducting part also, a sliding action is performed in effecting contact/separation of the conductor of the power circuit switch and the conductor of the main circuit. Grease is applied to such portions also.

As the conventional grease which is used for such sliding portions, typically, grease is employed containing a urea thickener, with a mineral oil base.

However, with the conventional grease, due to solidification or thickening (a deterioration of the sliding condition) caused by deterioration over a period of years, the short-time operating performance is adversely affected and there is a possibility of the sliding member becoming inoperable; periodic maintenance of the grease has therefore been considered necessary.

Also, in power circuit switches, the sliding member may be left under elevated-temperature conditions due to the generation of heat by the high voltage and high current. In such cases, the conventional grease was liable to deteriorate due to poor durability under elevated-temperature conditions. This therefore led to the drawback that, in sliding parts of the conducting part etc., contact resistance of the conductor was increased due to solidification of the grease, resulting in increased local heating, causing the power loss to become large.

SUMMARY OF THE INVENTION

Accordingly one object of the present invention is to provide a novel power circuit switch of excellent long-term reliability by reducing the power loss by suppressing the contact resistance of the conducting parts to a low level and improving operating reliability of the power circuit switch over a long period, by using a grease of improved performance in respect of deterioration over a period of years in a power circuit switch.

In order to achieve the above object, a power circuit switch according to the present invention comprises an operating mechanism that drives contact/separation of contacts, and a sliding conduction part that forms electrical contacting of these contacts and a main circuit on receiving a contact pressure, grease being applied to the mechanical sliding part of the operating mechanism and to the sliding conduction part, wherein the grease has as base oil at least one synthetic oil whose kinematic viscosity is 30–500 $mm^2/s$ at 40° C. and is selected from the group consisting of poly α-olefins, poly α-olefin hydrides and dialkyl diphenyl ethers, and contains as thickener 5–30 mass % of a urea compound.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
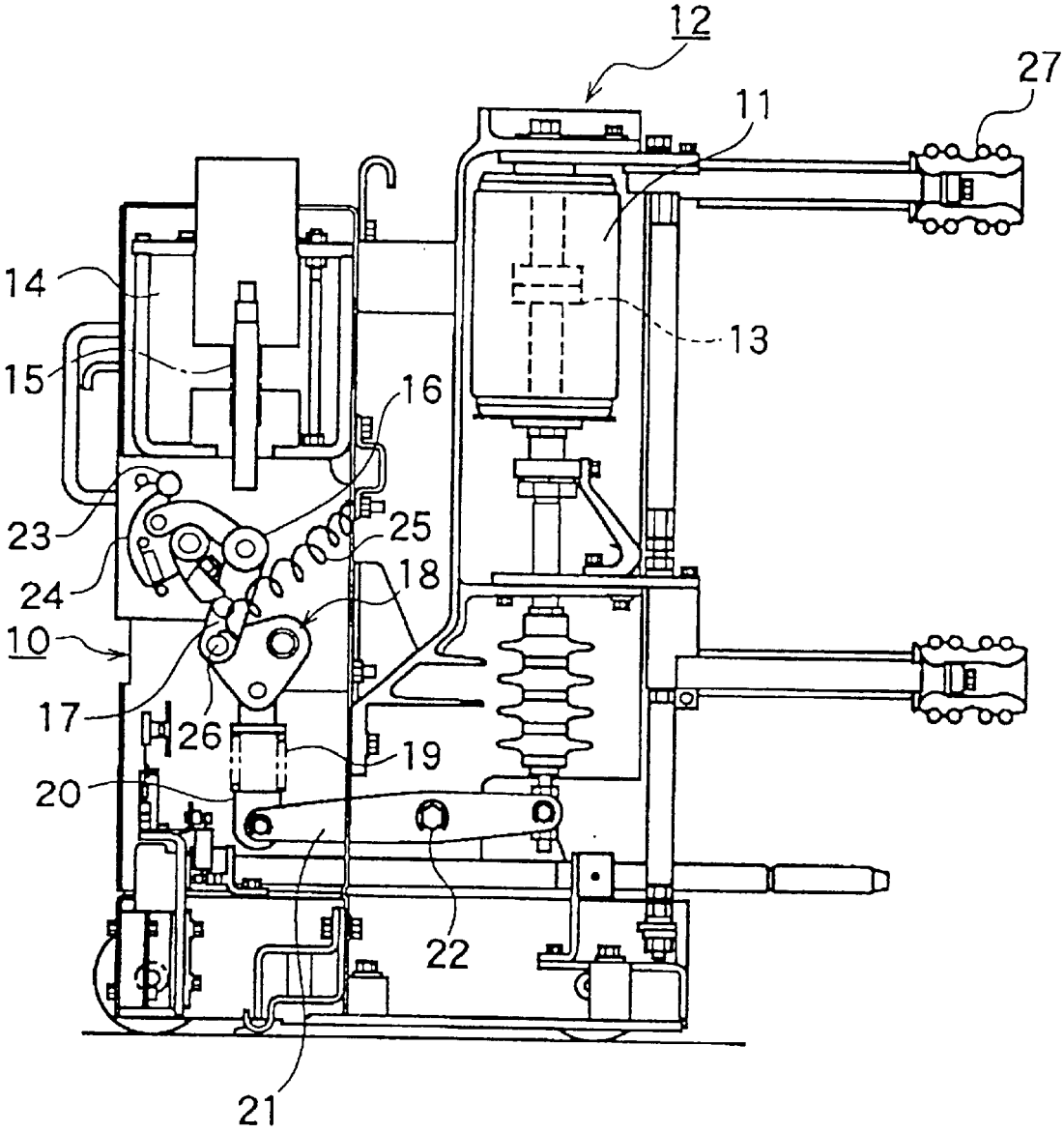
FIG. 1 is a diagrammatic layout view of a power circuit switch according to the present invention.

Referring now to the drawings, wherein like reference numerals designate identical or corresponding parts throughout the several views, and more particularly to FIG. 1 thereof, one embodiment of the present invention will be described.

First of all, grease according to the present invention employed in a power circuit switch will be described.

The grease employed in the present invention at a sliding part of a power circuit switch comprises as base oil at least one type of synthetic oil selected from the group consisting of poly α-olefins, poly α-olefin hydrides and dialkyl diphenyl ethers, and containing 5 to 30 mass % of a urea compound as thickener.

The at least one kind of synthetic oil selected from the group consisting of poly α-olefins, poly α-olefin hydrides and dialkyl diphenyl ethers used as the base oil is desirable as a grease constituent of a power circuit switch on account of its excellent thermal stability. As the α-olefins in the aforementioned poly α-olefins and poly α-olefin hydrides, α-olefins of carbon number 8 to 12, which may be either straight-chain or branched, are preferably employed. Even more preferably, straight-chain poly α-olefins of carbon number 8 to 12 are employed, specific examples that may be given including 1-octene, 1-nonene, 1-decene, 1-undecene, and 1-dodecene and mixtures of these.

As preferred examples of the poly α-olefin hydrides employed, compounds represented by the following general formula (1) may be mentioned.

(1)

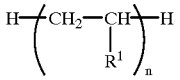

where, in this formula, $R^1$ represents a straight-chain or branched alkyl group of carbon number 6 to 10 and n represents an integer of 3 to 8.

As further preferred examples of poly a-olefin hydrides, there may be mentioned straight-chain a-olefin oligomers in which the $R^1$ in formula (1) is a straight-chain hexyl group, straight-chain heptyl group, straight-chain octyl group, straight-chain nonyl group, or straight-chain decyl group etc.

Also, as preferred examples of dialkyl diphenyl ethers used as a base oil, compounds represented by the general formula (2) given below may be mentioned:

(2)

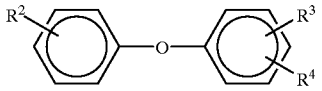

where, in this formula, one of $R^2$, $R^3$ and $R^4$ is a hydrogen atom and two of the others are alkyl groups of carbon number 8 to 20; the alkyl groups may be the same or different and may be straight-chain or branched.

As examples of alkyl groups of the chemical compounds (that is to say, compounds) of formula (2), there may be mentioned octyl groups, nonyl groups, decyl groups, undecyl groups, dodecyl groups, tridecyl groups, tetradecyl groups, pentadecyl groups, hexadecyl groups, heptadecyl groups, octadecyl groups, nonadecyl groups, or eicosyl groups etc. (these alkyl groups may be straight-chain or branched); of chemical compounds having such alkyl groups, chemical compounds wherein the carbon number of the alkyl groups is 12 to 14 are particularly preferred.

The kinematic viscosity of the base oil is at least 30 $mm^2/s$ and no more than 500 $mm^2/s$ at 40° C. If the kinematic viscosity at 40° C. is less than 30 $mm^2/s$, the ability to withstand sliding under high-temperature conditions is insufficient and if it is more than 500 $mm^2/s$, the contact resistance becomes large, so satisfactory sliding performance is not obtained. Preferably, base oil of kinematic viscosity at least 40 $mm^2/s$ but no more than 450 $mm^2/s$ at 40° C. is employed.

Specific examples of urea compounds constituting grease thickeners in the present invention are diurea compounds, triurea compounds, tetraurea compounds, polyurea compounds, or mixtures of these of these, the most preferred are diurea compounds, of which compounds represented by the following general formula (3) are preferable; either a single compound or a mixture may be employed.

$$R^5—NHCONH—R^6—NHCONH—R^7 \quad (3)$$

where, in this formula, $R^6$ represents a divalent hydrocarbon group, and $R^5$ and $R^7$ are hydrocarbon groups of respective carbon number 6 to 20, and may be the same or different.

$R^6$ in the above formula (3) is preferably a divalent hydrocarbon group of carbon number 6 to 20, and particularly preferably is a divalent hydrocarbon group of carbon number 6 to 15. Examples of divalent hydrocarbon groups that may be mentioned include straight-chain or branched alkylene groups, straight-chain or branched alkenylene groups, cycloalkylene groups and aromatic groups. As a specific examples of $R^6$ there may be mentioned ethylene groups, 2,2-dimethyl-4-methylhexylene groups and groups represented by the following formulas (4) to (13); of these, groups represented by the formulas (7), (8) are particularly. preferred.

(4)

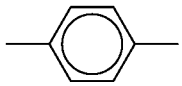

(5)

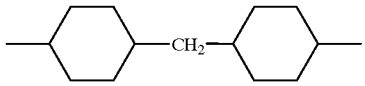

(6)

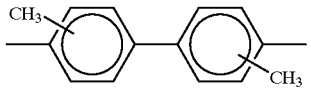

(7)

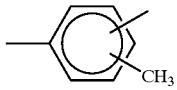

(8)

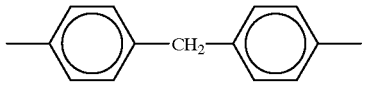

(9)

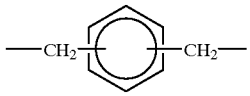

(10)

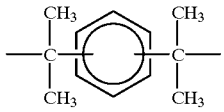

(11)

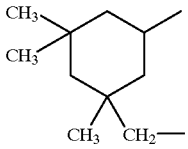

(12)

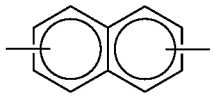

(13)

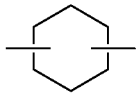

$R^5$ and $R^7$ in general formula (3) represent hydrocarbon groups of respective carbon numbers 6 to 20, preferably hydrocarbon groups of 8 to 18; as even more preferred examples, there may be mentioned straight-chain or branched alkyl groups, straight-chain or branched alkenyl groups, cycloalkyl groups, alkylcycloalkyl groups, aryl groups, alkylaryl groups, or arylalkyl groups etc.

Specifically, as $R^5$ and $R^7$, there may be mentioned straight-chain or branched alkyl groups such as hexyl groups, heptyl groups, octyl groups, nonyl groups, decyl groups, undecyl groups, dodecyl groups, tridecyl groups, tetradecyl groups, pentadecyl groups, hexadecyl groups, heptadecyl groups, octadecyl groups, nonadecyl groups or eicosyl groups; straight-chain or branched alkenyl groups such as hexenyl groups, heptenyl groups, octenyl groups, nonenyl groups, decenyl groups, undecenyl groups, dodecenyl groups, tridecenyl groups, tetradecenyl groups, pentadecenyl groups, hexadecenyl groups, heptadecenyl groups, octadecenyl groups, nonadecenyl groups, or eicosenyl groups; cyclohexyl groups; alkylcycloalkyl groups such as methylcyclohexyl groups, dimethylcyclohexyl groups, ethylcyclohexyl groups, diethylcyclohexyl groups, propylcyclohexyl groups, isopropylcyclohexyl groups, 1-methyl-3-propylcyclohexyl groups, butylcyclohexyl groups, amylcyclohexyl groups, amylmethylcyclohexyl groups, hexylcyclohexyl groups, heptylcyclohexyl groups, octylcyclohexyl groups, nonylcyclohexyl groups, decylcyclohexyl groups, undecylcyclohexyl groups, dodecylcyclohexyl groups, tridecylcyclohexyl groups, or tetradecylcyclohexyl groups; aryl groups such as phenyl groups or naphthyl groups; alkylaryl groups such as toluyl groups, ethylphenyl groups, xylyl groups, propylphenyl groups, cumenyl groups, methylnaphthyl groups, ethylnaphthyl groups, dimethylnaphthyl groups, or propylnaphthyl groups; or arylalkyl groups such as benzyl groups, methylbenzyl groups, or ethylbenzyl groups; of these, cyclohexyl groups octadecyl groups and toluyl groups are particularly suitable.

Any desired method of manufacturing the diurea compounds indicated by this general formula (3) may be employed and they may be obtained for example by reacting a diisocyanate represented by the general formula: OCN—$R^6$—NCO with an amino compound represented by general formula: $R^5$—$NH_2$ and an amino compound represented by the general formula: $R^7$—$NH_2$ in base oil at 10–200° C. $R^5$, $R^6$ and $R^7$ of the groups of the above diisocyanate and amine compounds have the same meaning as $R^5$, $R^6$ and $R^7$ of the compounds of the foregoing general formula (3).

Regarding the content ratio of the urea compound constituting the thickener, referred to the total quantity of the grease, the lower limit is 5 mass %, and the upper limit is 30 mass %, 6 to 20 mass % being preferable. If the content ratio of thickener is less than 5 mass %, its effectiveness as a thickener is small, so grease having sufficient thickness is not obtained; on the other hand, if it is more than 30 mass %, the grease becomes too hard, with the result that it cannot exhibit sufficient sliding performance.

So long as its properties are not impaired, the grease of the present invention may contain at least one additive selected from solid lubricants, extreme-pressure agents, antioxidants, oiliness agents, rust inhibitors, or viscosity index improvers, in accordance with requirements, in order to further improve its performance. When solid lubricants are included, any desired content may be employed, but, preferably, the content is 0.05 to 10.0 mass % with respect to the total quantity of the grease composition, and even more preferably 0.1 to 5.0 mass %.

As solid lubricating agent, there may be employed for example graphite, fluorinated graphite, boron nitride, polytetrafluoroethylene, molybdenum disulfide, and antimony sulfide, or alkaline (earth) metal borates.

As extreme-pressure agents, there may be mentioned for example organic zinc compounds such as zinc dialkyldithiophosphate, zinc diaryldithiophosphate, or zinc dialkyldithiocarbamate; organic molybdenum compounds such as molybdenum dialkyl dithiophosphate, molybdenum diaryl dithiophosphate, or molybdenum dialkyl dithiocarbamate; thiocarbamyl compounds; and phosphates or phosphites. When extreme-pressure agents are included, any desired content may be employed, but, preferably, the content is 0.05 to 10.0 mass % with respect to the total quantity of the grease composition, and even more preferably 0.1 to 7.0 mass %.

As antioxidants there may be mentioned for example phenol compounds such as 2,6-di-t-butylphenol, or 2,6-di-t-butyl-p-cresol, amino compounds such as dialkyl diphenylamine, phenyl-α-naphthylamine, or p-alkylphenyl-α-naphthylamine; sulfur compounds; or phenothiazine compounds. When antioxidants are included, any desired content may be employed, but, preferably, the content is 0.05 to 15.0 mass % with respect to the total quantity of the grease composition, and even more preferably 0.5 to 10.0 mass %.

As oiliness agents there may be mentioned for example amines such as lauryl amine, myristyl amine, palmityl amine, stearyl amine, or oleyl amine; higher alcohols such as lauryl alcohol, myristyl alcohol, palmityl alcohol, stearyl alcohol, or oleyl alcohol; higher fatty acids such as lauric acid, myristic acid, palmitic acid, stearic acid or oleic acid; fatty acid esters such as methyl laurate, methyl myristate, methyl palmitate, methyl stearate, or methyl oleate; amides such as lauryl amide, myristyl amide, palmityl amide, stearyl amide, or oleyl amide; or oils and fats. When oiliness agents are included, any desired content may be employed, but, preferably, the content is 0.05 to 10.0 mass % with respect to the total quantity of the grease composition, and even more preferably 0.1 to 7.0 mass %.

As rust inhibitors, there may be mentioned for example metallic soaps; partial esters of polyalcohol alcohol such as sorbitan fatty acid esters; amines; phosphoric acid; or phosphates. When rust inhibitors are included, any desired content may be employed, but, preferably, the content is 0.05 to 10.0 mass % with respect to the total quantity of the grease composition, and even more preferably 0.1 to 7.0 mass %.

As viscosity index improvers, there may be mentioned for example polymethacrylates, polyisobutylene, or polystyrene. When viscosity index improvers are included, any desired content may be employed, but, preferably, the content is 0.05 to 15.0 mass % with respect to the total quantity of the grease composition, and even more preferably 0.1 to 10.0 mass %.

Practical examples of power circuit switches according to the present invention in which the grease described above is applied to the sliding parts are illustrated in FIG. 1 to FIG. 5. In FIG. 1 to FIG. 5, members or parts given the same reference numerals designate identical members or identical parts.

The power circuit switch shown in FIG. 1 has the construction of a typical vacuum circuit breaker. As shown in the Figure, an operating mechanism 10 is arranged on the left side, and on the opposite side i.e. the right side there is arranged a high-voltage charging-unit 12 chiefly constituted by vacuum valve (vacuum interrupter) 11. The arrangement is such that driving one of the pair of contacts i.e. moveable electrode 13 of the vacuum valve 11 by operation of operating mechanism 10 effects opening/closing of the power circuit by producing contact/separation.

The switching operation will now be described with reference to FIG. 2 and FIG. 3 which illustrate diagrammatically the operating mechanism of the power circuit switch of FIG. 1.

Figure 2:
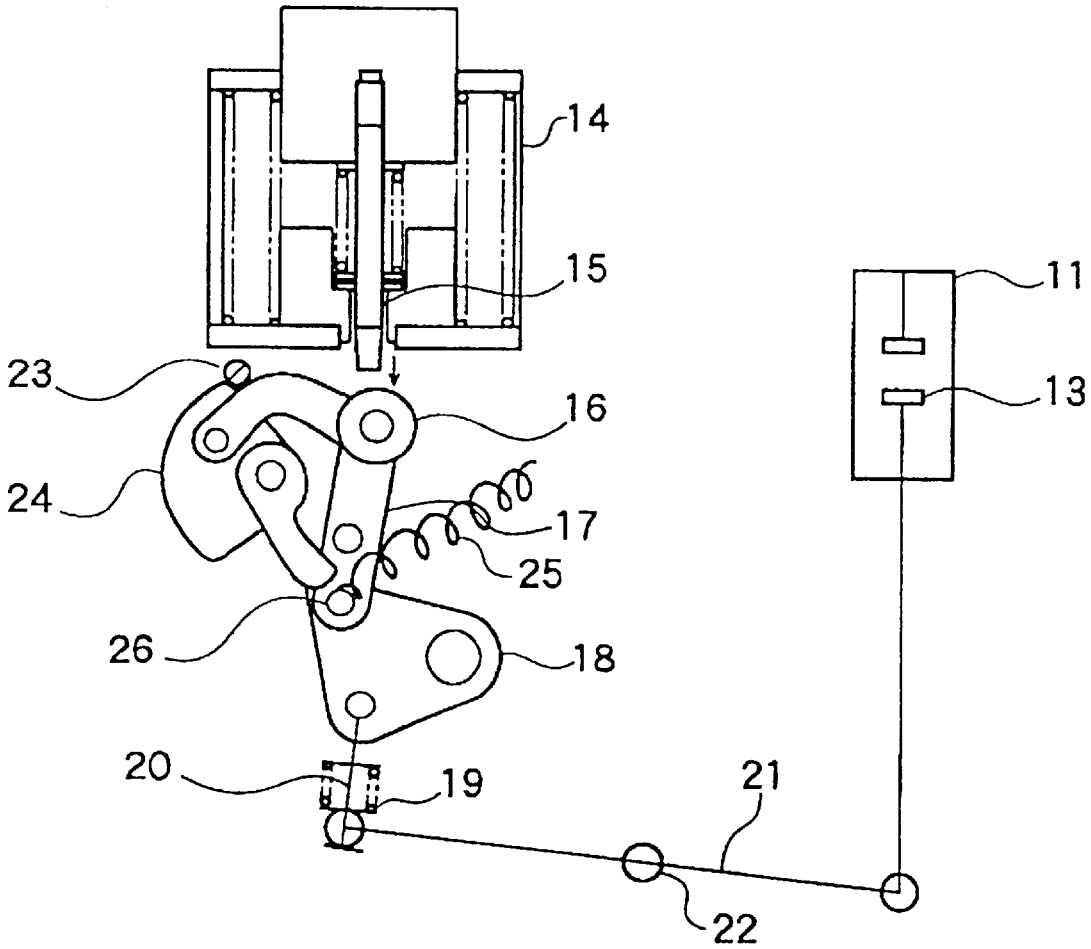
FIG. 2 is a simplified diagram illustrating the open-circuit condition of a power circuit switch given in explanation of the operating mechanism of the power circuit switch of FIG. 1.

First of all, when a closure instruction is applied in the open circuit condition shown in FIG. 2, closing coil 14 is excited. In response to this, armature rod 15 (moveable core) 15 pushes roller 16 downwards, so that a link 17, one end of which is engaged with roller 16, is pushed downwards against opening spring 25. The other end of link 17 is engaged with a rotor of main shaft 18, so main shaft 18 is rotated in the anti-clockwise direction. By the rotary operation of main shaft 18, one end of a drive lever 21 which is engaged with link 20 having a contact-pressurizing spring 19 is pushed downwards. Drive lever 21 is thereby rotated in the anti-clockwise direction about fulcrum 22, thereby pushing moveable electrode 13 of vacuum valve 11 which is connected with the other end of drive lever 21 upwards; vacuum valve 11 is thereby put in the closed circuit condition shown in FIG. 3, and the closure operation is completed.

Figure 3:
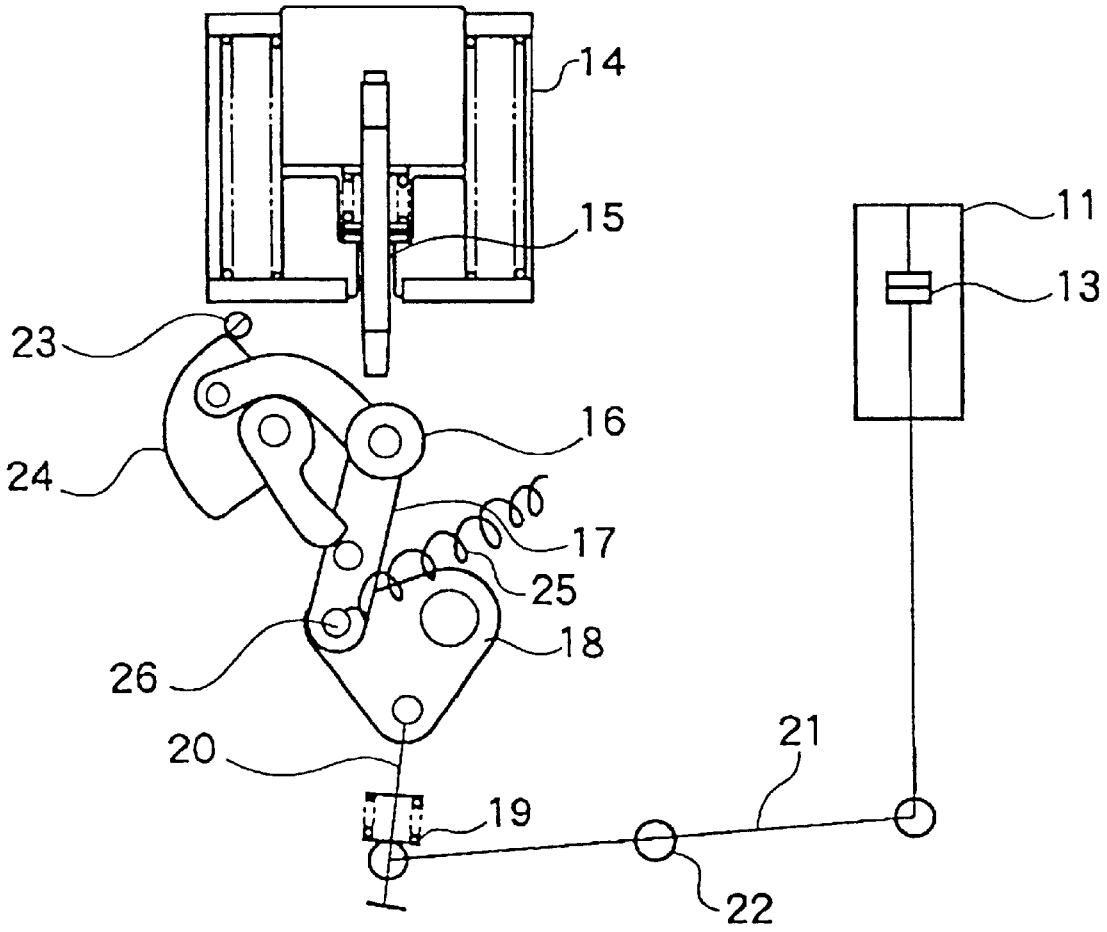
FIG. 3 is a simplified diagram illustrating the closed-circuit condition of a power circuit switch given in explanation of the operating mechanism of the power circuit switch of FIG. 1.

Next, when an open circuit instruction is applied in the closed circuit condition of FIG. 3, a trip shaft 23 which is of a partially half-moon shaped cross-sectional form is rotated in the clockwise direction by the action of a trip coil, not shown. Engagement of link 24 by trip shaft 23 is thereby released, allowing link 24 to rotate and releasing the non-return condition of link 17, with the result that link 17 is pulled back by opening spring 25, and main shaft 18 is rotated in the clockwise direction. The subsequent operation is the reverse of the operation for circuit closure described above: moveable electrode 13 of the vacuum valve is driven downwards, producing an open circuit condition as shown in FIG. 2, thereby completing the opening action.

A thin layer of grease is applied uniformly to the sliding parts of the operating mechanism that performs the action described above, such as for example the bearings arranged at the ends of main shaft 18 and the sliding engagement parts such as link 17 and pin 26. Frictional wear of the sliding parts is thereby prevented, and smooth operation maintained.

Figure 4:
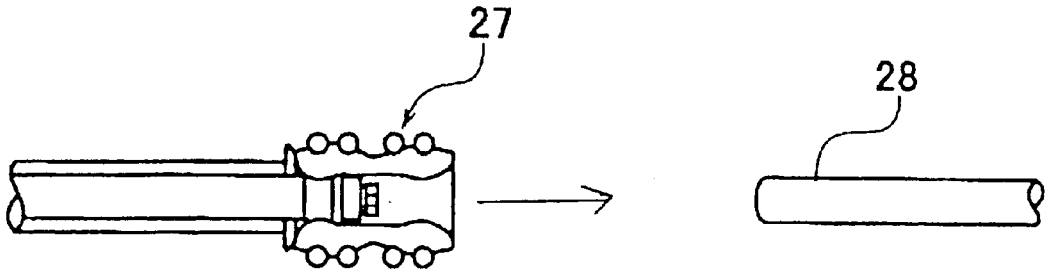
FIG. 4 is a diagram illustrating a disconnected condition at a conducting part of the power circuit switch of FIG. 1.
Figure 5:
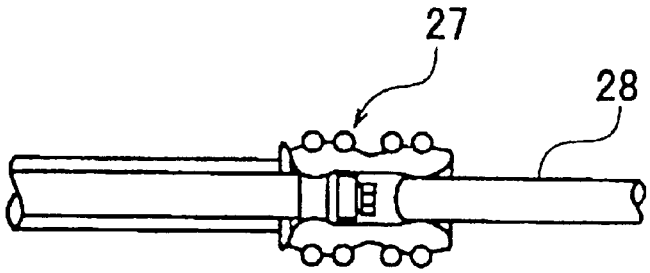
FIG. 5 is a diagram given in explanation of conductor connection at the conducting part of FIG. 4.

In the connection with the switch and the power circuit i.e. the main circuit, typically, a circuit breaker accommodated in a metal enclosed switchboard is employed, the electrical connection of the power circuit switch and main circuit being formed by connecting the distribution unit of the power circuit switch with the main circuit conductor 28 on the switchboard side. The conducting part of the power circuit switch has a finger unit 27 as shown in FIG. 1; as shown in FIG. 4, the finger part 27 of the conducting part is put in disconnected condition by isolating it from the main circuit conductor 28 on the switchboard side, so that conductor 28 is inserted in the finger part 27 shown in FIG. 5, thereby putting conductor 28 and the conductor within finger part 27 in contact, producing a conductive condition. Normally, the power circuit switch is used in the conductive condition, but is put in disconnected condition in the event of standby. When conductor 28 is inserted into finger part 27, conductor 28 slides over the inside surface of finger part 27, so a smooth sliding action is obtained by applying grease to this sliding portion, and stable conduction is maintained between conductor 28 and the conductor of finger part 27 after connection. Also, since the grease does not readily deteriorate even in response to rise in temperature produced by passage of current, sliding performance is maintained, so increase in the contact resistance between the conductors can be prevented.

The present invention is further described in detail below using practical examples and comparative examples, but the present invention is not restricted to these.

Practical Examples 1 to 2 and Comparative Example 1

In the examples, grease was prepared using as thickener raw-material diphenyl methane-4, 4'-diisocyanate and cyclohexylamine and the base oil shown in Table 1, containing, in the base oil in the proportions shown in Table 1, as thickener, a diurea compound (3) in which $R^5$ and $R^7$ are cyclohexyl groups and $R^6$ is a group of the aforementioned general formula (8). The dialkyl diphenyl ether constituting the base oil was a mixture of compounds represented by general formula (2), in which one of $R^2$, $R^3$, and $R^4$ is a hydrogen atom while two of the others are alkyl groups of carbon number 12 to 14; the poly α-olefin hydride was a mixture of compounds represented by general formula (1) wherein $R^1$ is an n-octyl group, of mean degree of polymerization (average value of n) of 6. The operation of preparation was conducted as follows.

First, diphenyl methane-4, 4'-diisocyanate and cyclohexylamine were added to the base oils separately indicated in Table 1 and heated to melting, to prepare respective mixtures with the base oils. Next, gel-form mixtures were obtained by blending these mixtures so as to obtain the compositional ratios shown in Table 1. The diurea compounds (3) were produced by reaction of the diisocyanate and cyclohexylamine by processing using a roll mill in which the gel-form mixtures obtained were prepared at room temperature, thereby obtaining the greases described above.

A thin layer of the grease was applied to a copper sheet, and inserted into a thermostat (thermostatic chamber) at 110° C., and the amount of evaporation at various temperatures indicated in Table 1, the carbonyl optical absorption and viscosity were measured. The measurement results are shown in Table 1 and FIGS. 6 to 8.

[TABLE 1]

| | Practical example 1 | Practical example 2 | Comparative example 1 |
|---|---|---|---|
| Composition (mass %) | | | |
| Base oil dialkyl diphenyl ether | 75 | 40 | — |
| poly α-olefin | — | 40 | — |
| Solvent refined mineral oil | — | — | 78 |
| Thickener | 15 | 10 | 12 |
| Other additives | | | |
| Anti-oxidant (phenyl-α-naphthylamine) | 10 | 8 | 10 |
| rust inhibitor (sorbitan fatty acid ester) | — | 2 | — |
| Base oil viscosity ($mm^2/s$, @40° C.) | 100 | 200 | 500 |
| Thickener raw material (mol ratios) | 1 | 1 | 1 |
| diphenylmethane-4,4-diisocyanate | 2 | 2 | 2 |
| cyclohexylamine | | | |
| Mean film thickness (mm) | 0.127 | 0.147 | 0.135 |
| Evaporation amount (mass %) | | | |
| 0 h | 0 | 0 | 0 |
| 1000 h | 7.884 | 8.662 | 7.629 |
| 2000 h | 9.736 | 10.95 | 11.50 |
| 3000 h | 11.07 | 12.64 | 14.35 |
| 4000 h | 12.84 | 14.59 | 17.02 |
| 5000 h | 14.53 | 16.88 | 18.72 |
| 6000 h | 16.46 | 18.98 | 19.97 |

[TABLE 1]-continued

| | Practical example 1 | Practical example 2 | Comparative example 1 |
|---|---|---|---|
| 7000 h | 17.83 | 20.92 | 20.93 |
| 8000 h | 19.42 | 22.51 | 22.31 |
| 9000 h | 20.91 | 23.90 | 23.15 |
| 10000 h | 23.31 | 25.97 | 24.49 |
| Carbonyl optical absorption | | | |
| 0 h | 0.023 | 0.017 | 0.025 |
| 1000 h | 0.026 | 0.028 | 0.39 |
| 2000 h | 0.057 | 0.076 | 0.52 |
| 3000 h | 0.052 | 0.038 | not measured |
| 4000 h | 0.085 | 0.110 | — |
| 5000 h | 0.083 | 0.081 | — |
| 6000 h | 0.095 | 0.080 | — |
| 7000 h | 0.145 | 0.102 | — |
| 8000 h | 0.174 | 0.121 | — |
| 9000 h | 0.221 | 0.195 | — |
| 10000 h | 0.223 | 0.180 | — |
| Consistency | | | |
| 0 h | 317 | 317 | 343 |
| 1000 h | 377 | 420 | 231 |
| 2000 h | 403 | 403 | solidifies |
| 3000 h | 394 | 420 | — |
| 4000 h | 368 | 386 | — |
| 5000 h | 351 | 377 | — |
| 6000 h | 334 | 343 | — |
| 7000 h | 291 | 325 | — |
| 8000 h | 274 | 282 | — |
| 9000 h | 256 | 265 | — |
| 10000 h | 205 | 231 | — |

As can be seen from the thin film test results of Table 1, in the case of the grease of comparative example 1 in which mineral oil was employed as the base oil, the carbonyl optical absorption increased extremely rapidly and the grease solidified, so that it was not of a condition permitting sliding. In comparison, the greases of the present invention of practical examples 1 and 2 did not solidify for a long time and variation of consistency was suppressed.

[Grease life]

The lives obtained when the grease of practical example 2 of the present invention and the conventional grease whose base oil was mineral oil of comparative example 1 were employed as a grease for the sliding members of the power circuit switch were calculated as follows using the results of the copper sheet thin film test (at 110° C.) shown in Table 1, and compared. Assuming that the ambient temperature of use of the power circuit switch was 40° C. and the rise in temperature within the box accommodating the switch during current passage was 15° C., the life was inferred under the conditions: temperature of use: 55° C. (40° C.+15° C.), limit of consistency indicating softness of the grease: 200.

(1) The times taken to reach the limiting consistency of 200 at 110° C. (endurance time) $L_{110A}$ (practical example 2) and $L_{110B}$ (comparative example 1) were predicted by an approximate calculation using the consistency at the time 10,000 hours (practical example 2) and at 1000 hours (comparative example 1) of Table 1.

1) In the case of the grease of practical example 2:

$$L_{110A} = 10{,}000\,\text{h} \times (317 - 200)/(317 - 231)$$
$$= 13605\,\text{h}$$

2) In the case of the grease of comparative example 1:

$$L_{110B} = 1{,}000\,\text{h} \times (343 - 200)/(343 - 231)$$
$$= 1277\,\text{h}$$

(2) The ratio of the endurance life $L_T$ at a temperature of use of T °C. and the endurance life L110 at 110° C. was taken as $K_T$.

$$K_T = L_T / \mathbf{L110}$$

In general, in the case of lubricating oils etc. containing grease, it is known that, when the temperature of use rises 10–15° C., the life becomes ½, so, assuming that the life of the grease is halved when the temperature of use changes by 15° C., the ratio $K_T$ referred to above is as follows:

$$K_T = 2^{(110-T)/15}$$

So the ratio $K_{55}$ when the temperature of use is 55° C. is:

$$K_{55} = 2^{(110-55)/15}$$
$$= 12.7$$

(3) Since the endurance life $L_T$ at temperature of use T is $L_T = K_T \times L_{110}$, the endurance life $L_{55A}$ (practical example 2) and $L_{55B}$ (comparative example 1) when the temperature of use is 55° C. were as follows:

1) In the case of practical example 2:

$$L_{55A} = K_{55} \times L_{110A}$$
$$= 12.7 \times 13605\,\text{h}$$
$$= 172783.5\,\text{h}$$
$$= 19.7 \text{ years endurance life: about 20 years}$$

2) In the case of comparative example 1

$$L_{55B} = K_{55} \times L_{110B}$$
$$= 12.7 \times 1277\,\text{h}$$
$$= 16217.9\,\text{h}$$
$$= 18.5 \text{ years endurance life: about 2 years}$$

As described above, if the endurance life of the grease at 55° C., which is the level of the ordinary temperature of use, is inferred, whereas, with the grease of comparative example 1, the consistency deteriorates and it solidifies to a level of less than 200 by about 2 years, with the grease of practical example 2, about 20 years are required for the same level of deterioration.

Consequently, it can be said that the grease of practical example 2 has an endurance life of about 10 times that of the comparative example 1.

Thus, a power circuit switch to which grease according to the present invention has been applied maintains high reliability over a long period, and extension of the maintenance period for lubrication which was conventionally necessary becomes possible; thus, a power circuit switch can be provided with which labor saving in respect of the maintenance and inspection operation by the user can be achieved.

(Other embodiments)

By including solid lubricants, extreme pressure agents, antioxidants, oiliness agents, rust inhibitors, and viscosity index improvers etc. in the grease of the above practical examples 1 and 2, as required in accordance with conditions of use such as the environment of use and purpose of use of the switch etc., specific performance can be further improved beyond the performance described above. Consequently, power circuit switches of high long-term reliability can be provided.

As described above, by applying grease according to the present invention to the sliding conduction part and operating mechanism of a power circuit switch, a power circuit switch can be provided in which in the operating mechanism deterioration of the grease over a period of years, deterioration of the actuation performance due to solidification, and occurrence of operating failures can be suppressed; also a power circuit switch can be provided which is of high reliability, having stable conduction performance over a long period, in which the effect of deterioration due to generation of heat on passage of current in the sliding conduction part is suppressed.

Although the practical examples described above were for the case of power circuit switches, the present invention could of course be applied to any mechanical device having sliding parts.

Obviously, numerous additional modifications and variations of the present invention are possible in the light of the above teachings. It is therefore to be understood that within the scope of the appended claims, the present invention may be practiced otherwise than as specially described herein.

What is claimed is:

1. A power circuit switch comprising:

an operating mechanism including a plurality of mechanical sliding parts and configured to open and close contacts;

a sliding conduction part configured to electrically connect said contacts with a main circuit on receipt of a connection voltage; and a grease deposited in said mechanical sliding parts of said operating mechanism and said sliding conduction part, wherein said grease contains a base oil including at least one synthetic oil whose kinematic viscosity is 30–500 $mm^2/s$ at 40° C. and which is selected from the group consisting of poly α-olefins, poly α-olefin hydrides and dialky diphenyl ethers, and a thickener including 5–30 mass % of a urea compound.

2. The power circuit switch according to claim 1, wherein said grease includes at least one of a solid lubricant, an extreme pressure agent, and antioxidant, an oiliness agent, a rust inhibitor and a viscosity index improver.

3. The power circuit switch according to claim 1, wherein said grease has a kinematic viscosity of at least 40 $mm^2/s$ and less than 450 $mm^2/s$ at ambient temperature of 40° C.

4. The power circuit switch according to claim 1, wherein a content ratio of said urea compound has a lower limit of 6 mass % and upper limit of 20 mass %, referred to the total amount of said grease.

5. The power circuit switch according to claim 2, wherein said solid lubricant is selected from the group consisting of graphite, fluorinated graphite, boron nitride, polytetrafluoroethylene, molybdenum disulfide, antimony sulfide, and an alkaline earth metal borate.

6. The power circuit switch according to claim 2, wherein said extreme pressure agent is selected from the group consisting of an organic zinc compound, an organic molybdenum compound, a phosphate, and a phosphite.

7. The power circuit switch according to claim 2, wherein said antioxidant is selected from the group consisting of a phenol compound, an amino compound, and a sulfur compound.

8. The power circuit switch according to claim 2, wherein said oiliness agent is selected from the group consisting of an amine, a higher alcohol, a higher fatty acid, a fatty acid ester, an amide, an oil, and a fat.

9. The power circuit switch according to claim 2, wherein said rust inhibitor is selected from the group consisting of a metallic soap, a partial ester of polyalcohol alcohol, an amine, and phosphoric acid, and a phosphate.

10. The power circuit switch according to claim 2, wherein said viscosity index improver is selected from the group consisting of polymethacrylate, polyisobutylene, and polystyrene.

11. The power circuit switch according to claim 2, wherein said grease includes at least one of said solid lubricant in an amount of 0.05 to 10.0 mass %, extreme pressure agent in an amount of 0.05 to 10.0 mass %, antioxidant in an amount of 0.05 to 15.0 mass %, oiliness agent in an amount of 0.05 to 10.0 mass %, rust inhibitor in an amount of 0.05 to 10.0 mass % and viscosity index improver in an amount of 0.05 to 15.0 mass % with respect to the total amount of said grease.

12. A power circuit switch comprising:

a plurality of contacts;

operating means for opening and closing the contacts, operating means including a plurality of mechanical sliding parts;

conduction means for electrically connecting said contacts with a main circuit on receipt of a connection voltage; and a grease deposited in said mechanical sliding parts and said conduction means, wherein said grease contains a base oil including at least one synthetic oil whose kinematic viscosity is 30–500 $mm^2/s$ at 40° C. and which is selected from the group consisting of poly α-olefins, poly α-olefin hydrides and dialky diphenyl ethers, and a thickener including 5–30 mass % of a urea compound.

13. The power circuit switch according to claim 12, wherein said grease includes at least one of a solid lubricant, an extreme pressure agent, an antioxidant, an oiliness agent, a rust inhibitor, and a viscosity index improver.

14. The power circuit switch according to claim 12, wherein said grease has a kinematic viscosity of at least 40 $Mm^2/s$ and less than 450 $mm^2/s$ at ambient temperature of 40° C.

15. The power circuit switch according to claim 12, wherein said urea compound has a content ratio whose lower limit is 6 mass % and upper limit is 20 mass % with respect to the total amount of said grease.

* * * * *

UNITED STATES PATENT AND TRADEMARK OFFICE

CERTIFICATE OF CORRECTION

PATENT NO. : 6,396,018 B1
DATED : May 28, 2002
INVENTOR(S) : Kinoshita et al.

It is certified that error appears in the above-identified patent and that said Letters Patent is hereby corrected as shown below:

Title page,
Item [75], the Inventor information should read as follows:
-- [75] Inventors: Hirotsugu Kinoshita; Kiyomi Sakamoto, both of Kanagawa-Ken; Kimiya Satoh, Saitama-Ken; Makoto Kataoka, Tokyo; Atsushi Ohashi, Kanagawa-Ken; Tomio Takahashi, Tokyo, all of (JP) --

Signed and Sealed this

Fifteenth Day of October, 2002

*Attest:*

*Attesting Officer*

JAMES E. ROGAN
*Director of the United States Patent and Trademark Office*